United States Patent [19]

Leshner

[11] Patent Number: 4,827,887

[45] Date of Patent: May 9, 1989

[54] ADAPTIVE CHARGE MIXTURE CONTROL SYSTEM FOR INTERNAL COMBUSTION ENGINE

[75] Inventor: Michael D. Leshner, Columbia, Md.

[73] Assignee: Sonex Research, Inc., Annapolis, Md.

[21] Appl. No.: 183,995

[22] Filed: Apr. 20, 1988

[51] Int. Cl.[4] ..... F02B 3/2

[52] U.S. Cl. ..... 123/493; 123/326

[58] Field of Search ..... 123/493, 442, 491, 453, 123/179 L, 326

[56] References Cited

U.S. PATENT DOCUMENTS

| | | | |
|---|---|---|---|
| 4,452,212 | 6/1984 | Takase | 123/493 |
| 4,480,621 | 11/1984 | Höppel | 123/493 |
| 4,510,902 | 4/1985 | Tsachida et al. | 123/493 |
| 4,535,744 | 8/1985 | Matsumura | 123/493 |
| 4,674,458 | 6/1987 | Mori | 123/493 |
| 4,747,387 | 5/1988 | Takao et al. | 123/493 |

*Primary Examiner*—Raymond A. Nelli
*Attorney, Agent, or Firm*—Bacon & Thomas

[57] ABSTRACT

An adaptive charge mixture control for an internal combustion engine includes four input signals supplied to an OR gate to generate a net "go rich" signal supplied to a servo motor controlling an air/fuel charge mixture control valve for an internal combustion engine. The servo is also supplied with a "go lean" fixed signal tending to lean out the air/fuel mixture. The four "go rich" signals include a first signal derived from a comparison of engine speed with a predetermined minimum (i.e., idle) level; a second signal derived from comparing throttle positions with a preset minimum throttle position; a third signal derived from comparing engine deceleration rate with a preset engine deceleration rate; and a fourth signal derived from a measurement of engine instantaneous power output.

5 Claims, 1 Drawing Sheet

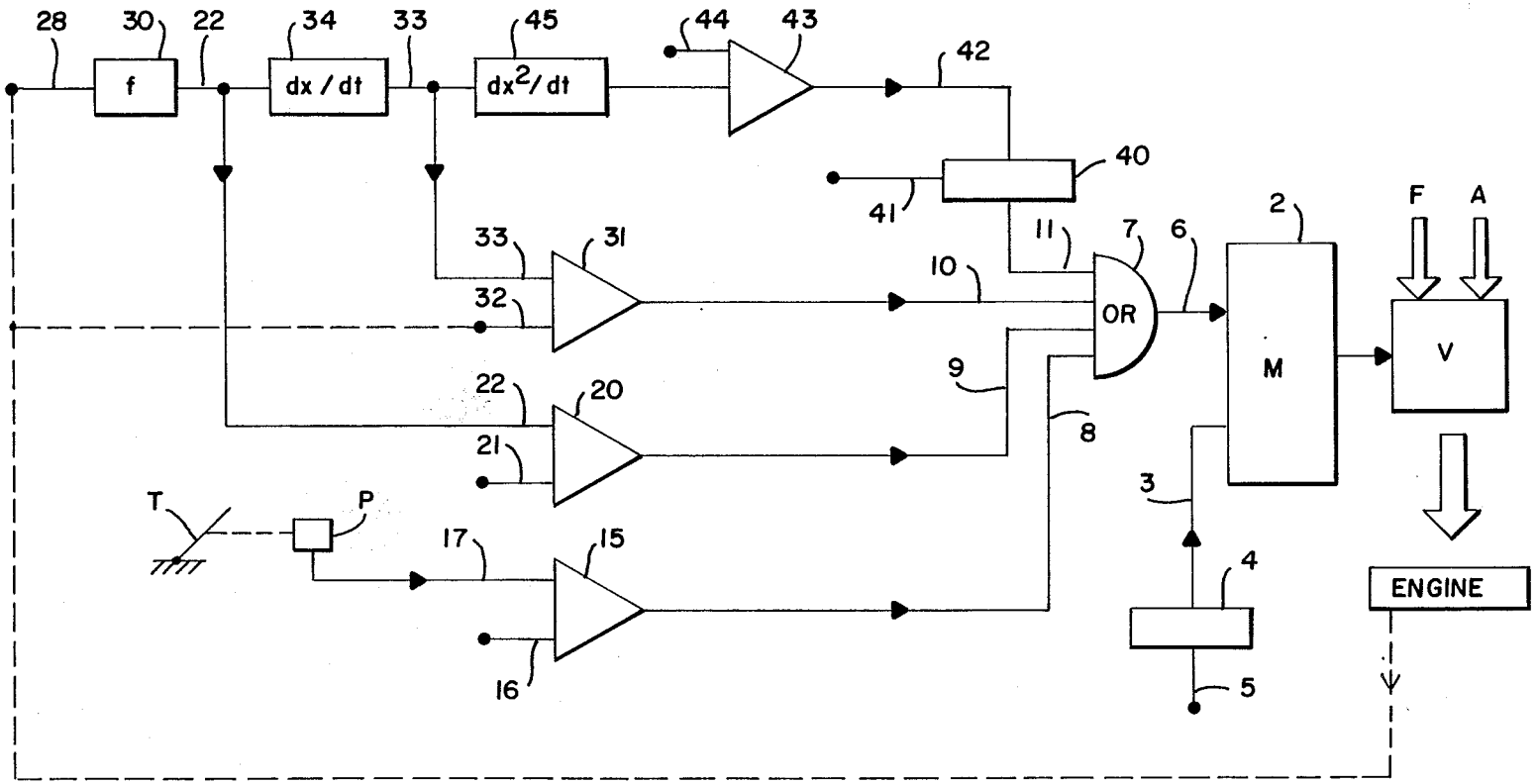
A
F
V
ENGINE
2
M
4
5
6
3
7
OR
40
8
11
42
10
9
41
43
44
31
20
15
45
dx2/dt
33
32
22
21
16
17
33
34
dx/dt
P
22
T
30
f
28

ADAPTIVE CHARGE MIXTURE CONTROL SYSTEM FOR INTERNAL COMBUSTION ENGINE

BACKGROUND OF THE INVENTION

This invention relates to emission control in automotive engines. Numerous proposals have been made for such control, including the use of "lean burn" mixtures of fuel/air. For example U.S. Pat. No. 4,368,707 (incorporated herein by reference) discloses a system wherein the ratio of fuel/air is varied by a servo valve in response to a control signal derived from engine power output.

However, there are problems in meeting emission control regulations under certain running conditions. Firstly, in the zero throttle condition, i.e., with manifold vacuum in excess of 20 in. Hg., the engine functions like a pump, and the lean burn mixture is ineffective. Combustion efficiency is poor and relatively large amounts of hydrocarbons may be released. Similarly, at low engine speeds, the lean burn mixture reduces the combustion temperature, once again adversely affecting combustion efficiency. Also, under deceleration conditions (reduced throttle) from speed, there is once again a departure from optimum burn. The system of U.S. Pat. No. 4,368,707 controls the fuel/air ratio to give optimum run quality. "Optimum run quality" means that for a given engine, the operating condition is maintained at a subjectively acceptable level, given tht excessively lean mixtures result in rough or uneven running characteristics. Where optimum exhaust emission control is achieved, the fuel/air mixture is close to the limit at which rough running results. According to U.S. Pat. No. 4,368,707 this is accomplished by feeding the final mixture control element (throttle valve) with two opposing signals, one causing enrichment on detection of a given deceleration rate and the second causing the mixture to go lean at a prechosen continuous rate. The result is that the rate of change of the fuel/air mixture is automatically proportional to the difference between the actual mixture and the desired mixture.

SUMMARY OF THE INVENTION

It is an object of this present invention to augment this control by altering the fuel/air mix so as to minimize emissions over a wider range of engine operating conditions.

According to the present invention, an emission control system includes means for comparing engine speed with a predetermined minimum level to derive a control signal therefrom, means for comparing throttle position with a preset throttle position to derive a second control signal therefrom, means for comparing deceleration rate with a preset deceleration rate to derive a third control signal therefrom, together with over-ride gate means responsive to said control signals to cause enrichment of the fuel/air mixture.

The first means preferably detects and responds to a preset idling speed. The second means is preferably set to detect a minimal or zero throttle condition, corresponding to "over-run" of a vehicle to which the system is fitted. The third means preferably responds to a preset rate of (negative) engine speed change (deceleration.) Advantageously, the system is integral with a control system of the kind described in U.S. Pat. No. 4,368,707, in that the "go rich" mixture enrichment signal is applied through the same over-ride gate means, so that the existing level of speed-related enrichment can be overridden, or at least augmented to meet specific and relatively extreme operating conditions.

BRIEF DESCRIPTION OF THE DRAWING

In order that the invention is better understood, one embodiment of it will now be described by way of example only with reference to the accompanying drawing in which the sole FIG. 1 is a block diagram.

In FIG. 1, a throttle valve 1 is used to regulate the fuel/air charge mixture fed to an internal combustion engine, (details of which are not shown) the valve 1 being operated by a servo-driver or motor 2 in response to two input signals. The first of these 3 is from a pulse generator 4 whose pulse rate can be preset, at source 5. This input signal 3 is set up to operate the servo driver 2 in the direction of an increasingly lean fuel/air mix. The second input signal, 6 is from an override "OR" gate 7. This latter gate responds to four input signals designated 8, 9, 10 and 11 respectively. The first of these, 8 is derived from a comparator 15. This is supplied with a preset throttle setting signal 16 which it compares with an actual throttle setting signal 17. The latter may be derived from a potentiometer P which is directly or indirectly connected to the throttle pedal T. The preset signal 16 is chosen to reflect a low or zero throttle position, so that the signal 8 supplied to the override gate 7 tends to cause enrichment of the mixture under low/zero throttle conditions, by over-riding the "go-lean" signal 3.

The signal 9 is derived from a comparator 20 which responds to two input signals. One of these, 21 is a preset signal corresponding to engine idling speed. The other input signal, 22 is derived directly from a measurement of engine speed 28. The method of obtaining this is optional; for example, the crankshaft speed can be determined by a pulse counting technique, the smoothed output being filtered (at 30) to remove extraneous noise. The effect of the signals 21, 22 on the comparator 20 is to cause enrichment of the fuel/air mix at low engine speeds, by causing the servo driver 2 to over-ride the "go-lean" signal 3.

The third input signal 10 to the override gate 2 is derived from a comparator 31, again having two input signals. The first of these, 32 is a preset signal selected to correspond to a given rate of deceleration of the engine. This is compared with a signal 33 derived by differentiating (at 34) the engine speed signal 22 (see above) to get a rate of change signal, 33. This is compared with the preset value 32 so as to cause enrichment via the override gate 2 to occur whenever the deceleration rate exceeds the preset value.

The fourth input signal to the override gate 2 is obtained by modulating (40) a preset pulse string in a pulse generator 41 with a signal 42 from a comparator 43. This latter comparator compares a preset trip level signal 44 with differentiated (45) signal 33 corresponding to rate of change of engine speed. This part of the system corresponds to a major part of the "poor running quality" detection arrangement of U.S. Pat. No. 4,368,707 and it will be seen that the latter system is now augmented by the inclusion of three further sources of over-ride signal, so that fuel/air mixture enrichment will take place at any time when engine running conditions depart from the range within which the system of U.S. Pat. No. 4,368,707 is most effective.

It will be appreciated that there are numerous ways of implementing the control circuitry described above without departing from the scope of the invention.

I claim:

1. A charge mixture control system for an internal combustion engine having a throttle speed control and a fuel/air charge mixture control including at least one of a first means for comparing engine speed with a predetermined minimum level to derive a control signal therefrom, second means for comparing throttle positions with a preset throttle position to derive a second control signal therefrom, and a third means for comparing engine deceleration rate with a preset engine deceleration rate to derive a third control signal therefrom, override gate means responsive to said control signals to generate an enrichment signal, said fuel/air charge mixture control arranged to receive said enrichment signal and to cause enrichment of the fuel/air charge mixture for the engine from a preset ratio in response thereto, said fuel/air charge mixture control also being supplied with a fixed signal which causes the mixture control to lean the charge at a fixed rate, whereby the fuel/air mix is altered at a rate proportional to the difference between the override gate means output signal and the fixed signal.

2. A system according to claim 1 including means for generating a fourth control signal derived from a measurement of engine instantaneous power output, said override gate means responsive to said fourth signal with said first, second and third signals.

3. Apparatus according to claim 1 wherein the first means compares engine speed with a preset idling speed.

4. Apparatus according to claim 1 wherein the second means compares actual throttle position with a minimal or zero throttle position.

5. Apparatus according to claim 1 wherein the third means compares the rate of engine speed to a preset rate of engine speed deceleration.

* * * * *